US006450342B1

(12) United States Patent
Ptaschinski

(10) Patent No.: US 6,450,342 B1
(45) Date of Patent: Sep. 17, 2002

(54) METHOD AND APPARATUS FOR PROVIDING A BICYCLE SHIPPING CONTAINER

(75) Inventor: Michael J. Ptaschinski, Beaver Dam, WI (US)

(73) Assignee: International Paper Co., Stamford, CT (US)

( * ) Notice: Subject to any disclaimer, the term of this patent is extended or adjusted under 35 U.S.C. 154(b) by 0 days.

(21) Appl. No.: 09/541,323

(22) Filed: Apr. 1, 2000

Related U.S. Application Data

(63) Continuation-in-part of application No. 09/063,195, filed on Apr. 20, 1998, now abandoned.

(51) Int. Cl.[7] ..... B65D 85/68
(52) U.S. Cl. ..... 206/588; 206/335
(58) Field of Search ..... 206/317, 319, 206/320, 333, 335, 588, 592; 229/120.18

(56) References Cited

U.S. PATENT DOCUMENTS 1,898,321 A * 2/1933 Weiss
2,060,513 A * 11/1936 Marx
3,106,331 A * 10/1963 Blackburn
3,199,762 A * 8/1965 Coons
3,235,163 A * 2/1966 Hennessey
3,682,297 A * 8/1972 Austin et al.
5,465,834 A * 11/1995 Sieber et al.

* cited by examiner

*Primary Examiner*—David T. Fidei

(57) ABSTRACT

An improved shipping carton is provided that is formed from a unitary blank comprising a sheet of material such as corrugated paperboard, and which includes an internal strut column/support member that acts as a divider and a support structure. The shipping carton formed from the unitary blank is suitable for packaging articles of irregular shape, such as a partially assembled bicycle. The unitary blank is formed in from a substantially rectangular shape, having multiple walls that are separated by fold lines, including: a first partial back wall portion has an outer vertical edge, and a glue strip located along the outer vertical edge for securing the first partial back wall portion to the surface of a second partial back wall portion; a first end wall; a front wall having a cutout suitable for use as a handhold; a second end wall; the second partial back wall portion having a scored fold line with a proximal glue strip that is to be mated to the glue strip located on the first partial back wall portion, and also having a cutout suitable for use as a second handhold; and a strut column/support member that is angularly pivotable along the fold line of the second partial back wall portion, and which includes a tongue having a glue strip for securing it to the inner surface of the front wall. The strut column/support member also having an elongated channel cutout usable for holding packaged articles in place, and a second tongue on the distal portion of a fold line that is at a right angle to the fold line of the second partial back wall portion, this second tongue having a deformable area that is formed by perforated fold lines, the deformable area also usable for holding packaged articles in place. The shipping carton can be partially erected into a flat preform for shipment from the carton manufacturer to the manufacturer/packager, where the shipping carton will be further erected into a packaging configuration to receive one or more articles within at least two containment volumes, all formed from the unitary blank.

18 Claims, 9 Drawing Sheets

METHOD AND APPARATUS FOR PROVIDING A BICYCLE SHIPPING CONTAINER

This application is a continuation-in-part of application Ser. No. 09/063,195, filed Apr. 20, 1998, now abandoned.

TECHNICAL FIELD

The present invention relates generally to a carton blank made of a sheet material such as corrugated paperboard, and is particularly directed to a completely erected carton or container made from the blank for packaging irregularly shaped articles, such as partially assembled bicycles. The invention is specifically disclosed as a carton blank that can be partially erected into a flat shipping configuration, and later placed into a packaging configuration for use as a container to hold articles in more than one containment volume, all made from the single carton blank.

BACKGROUND OF THE INVENTION

Corrugated paperboard cartons are quite common in the art, and this includes paperboard cartons designed to hold partially assembled bicycles. In conventional such paperboard cartons, separate inserts have been used to strengthen the container, and for adding a certain amount of padding to the structure. Such inserts represent additional parts that are required to properly construct the final erected carton in its configuration for use in holding a partially assembled bicycle. These extra parts can be a problem at the point of filling the carton with its typical contents (e.g., a partially assembled bicycle), especially when such extra parts may become lost or otherwise temporarily separated from the main carton itself when it is time for the carton to receive the partially assembled bicycle.

Some primary objectives of good carton design include the avoidance of waste, and the construction of a final container that requires as few separate pieces as possible. The most desirable form for a container or carton that is to be used for shipping a product is for this container to be constructed of a single piece of sheet material as a unitary structure, from which the entire container would be formed, including all of its strengthening and padding sub-structures.

The type of container or carton that is required for packaging a bicycle has an inherent weakness because the carton typically must be relatively long, high, and narrow. Internal strengthening is needed so that the carton and its contents are able to withstand the pressures of stacking and handling by forklifts, and the like during storage and shipping. The required internal strengthening has usually been in the form of internal bracing that is embodied into the carton design. Usually this internal bracing comprises the same or similar type of paperboard sheet material used for the body of the carton itself, which is folded into various shapes to form the strengthening struts.

A carton for containing a partially assembled bicycle often requires more than one separate compartment to hold a main sub-assembly, and also to hold various bicycle parts or other contents, and to prevent them from migrating inside the container during shipping. The internal bracing provided has often been arranged to perform this separate compartment function. Most of the conventional cartons for holding structures such as partially assembled bicycles have used inserts for strengthening and for any padding constructs of the container. The separate inserts are commonly made from separate panels, which often are of the same type of corrugated sheet material used for the main container. As noted above, when more than one separate piece is required for a complete carton, there are problems inherent with controlling the inventory of these various parts of the container, and further there will be additional work involved in erecting the multiple portions of a container that require multiple parts.

Some conventional cartons have been used without the internal bracing and padding, in which the carton is made of a rectangular shape. It is difficult, however, to begin with a blank that starts out as a rectangular sheet made of paperboard or other material, and then to shape that rectangular sheet so as to form the strengthening constructs and any other required padding, or other type of structural holding portions, out of the single unitary rectangular sheet. This is particularly, true if the carton manufacturer is attempting to ship the carton in a flat form to the packager, and particularly if no separate parts are to be used for the final assembly of the carton.

While the carton manufacturer desires to form a carton blank that can be shipped flat with no additional assembly steps (using separate parts) required by the packager, it is also important for the packager to be able to assemble a carton blank without the use of any extra separate parts. One solution is to fasten the extra parts to the interior of the erected carton, but that then defeats the desired goal of shipping a flat carton blank to the manufacturer/packager. Any assembly of separate parts that is required by the manufacturer/packager will create additional steps and complications (such as inventory control).

SUMMARY OF THE INVENTION

Accordingly, it is a primary advantage of the present invention to provide a paperboard carton formed from a single unitary piece of corrugated sheet material. It is another advantage of the present invention to use a paperboard carton formed from a unitary piece that can be erected into a single integral package for shipping a partially assembled bicycle, or to ship some other size-restricted product. It is a further advantage of the present invention to use a paperboard carton formed from a unitary piece of sheet material that provides an internal divider within the erected carton, in which however, the divider is part of the unitary structure of the original carton blank. It is yet another advantage of the present invention to provide a carton with a tongue member that is designed to hold a wheel of a partially assembled bicycle in place, in which the tongue member is constructed as part of the carton's divider, and wherein all of these structures are part of the unitary blank of sheet material.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, an improved shipping carton is provided that is formed from a unitary blank comprising a sheet of material such as corrugated paperboard, and which includes an internal strut column/support member that acts as a divider and a support structure. The shipping carton formed from the unitary blank is suitable for packaging articles of irregular shape, such as a partially assembled bicycle. The unitary blank is formed from sheet material in a shape, from one end of the blank to the other end, as follows:

1. a first partial back wall portion having an outer vertical edge, and a glue strip located along the outer vertical edge for securing the first partial back wall portion to the surface of a second partial back wall portion, 2. a first end wall,
3. a front wall having a cutout suitable for use as a handhold,
4. a second end wall,
5. the aforementioned second partial back wall portion having a scored fold line with a proximal glue strip that is to be mated to the glue strip located on the first partial back wall portion, and also having a cutout suitable for use as a second handhold,
6. a strut column/support member that is angularly pivotable along the fold line of the second partial back wall portion, and which includes a tongue having a glue strip for securing it to the inner surface of the front wall, the strut column/support member having an elongated channel cutout usable for holding packaged articles in place, the strut column/support member having a second tongue on the distal portion of a second fold line that is at a right angle to the fold line of the second partial back wall portion, this second tongue having a deformable area that is formed by perforated a fold lines, the deformable area also usable for holding packaged articles in place.

Each of the adjacent walls have a (vertical) scored fold line between them and are thereby foldable with respect to each other along these scored fold lines. In addition, each of the walls extend upward and downward to form top flaps and bottom flaps, separated by (horizontal) scored fold lines, in which these flaps form the top and bottom of the carton once fully erected. In a preferred embodiment, the flaps are separated from their respective associated walls by a co-linear (horizontal) scored fold line with respect to the carton blank's appearance when it is laid out flat.

The strut column/support member and its upper second tongue are separated by a scored fold line, as noted above, and this scored fold line preferably is co-linear with respect to the other (horizontal) scored fold lines that separate the top flaps from their respective walls. The strut column/support member folds into the carton when it is partially erected, thereby forming a (vertical) structural column between the front wall and back wall of the container. This strut column/support member not only provides a structural support between the front and back walls of the container, but also creates a separate compartment for packaging loose parts such as those associated with a partially assembled bicycle. Moreover, the elongated. channel cutout of the vertical strut column/support member is useful for maintaining a wheel of the bicycle in a desired relationship to the erected carton, and also provides shock protection to the bicycle wheel. Furthermore, the second tongue can be folded downward such that its deformable area is pushed against the upper surface of the bicycle's wheel, thereby deforming along perforated fold lines to create "fingers" of the deformable area, and also thereby more rigidly maintaining the structural integrity for maintaining the bicycle wheel in its desired relationship to the erected carton.

The shipping carton or container of the present invention can be partially erected into a flat preform for shipment from the carton manufacturer to the manufacturer of the parts or sub-assemblies that are to be packaged therewithin. While in this flat "shipping" preform configuration, the strut column/support member is already fixedly attached to the inner surfaces of both the front wall and the back wall, and the strut column/support member will maintain that fixed relationship at various angles, depending upon whether or not the carton remains flat, or becomes opened into its rectangular product-receiving or "packaging" configuration. Once the flat preform has been received at the manufacturer/packager who will use the carton for packaging a product, the carton can be adjusted so that its end wall pieces become substantially rectangular to the front and back walls, which will also automatically cause the strut column/support member to maintain a right angle relationship to the front and back walls. The bottom flaps can then be folded along the scored fold lines so that the carton has a fold bottom, and then the manufactured item (such as a bicycle) can then be inserted within the almost completely erected carton. Once the manufactured articles have been placed therewithin, the top flaps can be folded along the scored fold lines to fold the top surface of the carton, and thereby make it ready for final shipping.

The procedure for utilizing the paperboard unitary blank of the present invention is as follows: once the carton blank has been manufactured, the front wall is folded with respect to its second end at a right angular relationship, and then the back wall is also folded with respect to the second end at a second right angular relationship. When this occurs, the back wall and front wall will be substantially parallel to one another. The strut column/support member is then folded at a substantially right angle with respect to the back wall and the first tongue of the strut column/support member is then folded at a substantially right angle so that the glue area (or glue tab) of the first tongue will mate against the inner surface of the front wall. Preferably, a second glue area will already have been applied to this same area on the inner surface of the front wall, so that the two glue areas will mate to one another.

Once that has been accomplished, the first end is folded at a substantially right angle with respect to the front wall, and then the first partial back wall is folded at a substantially right angle with respect to the first end wall. When that occurs, a glue area of the first partial back wall should mate up to a similar glue area on the outer surface of the second partial back wall (which is the back wall's main portion). Once these glue areas are mated together, the carton will have a substantially rectangular appearance, when seen from above if standing in a vertical position. In this configuration, the carton is in a first preform configuration, and can be folded flat merely by causing the right angle comers to fold inward on two of the diagonal comers of the rectangular "box" as seen from above. By folding the carton flat, it is ready for shipping in its most compact configuration (in a "shipping" configuration).

Now that the carton is shipped and after it is received by the packager, the carton is ready for its final assembly. The procedure now is to unfold the carton from its flat preform shipping configuration, and to cause it to be placed back into its rectangular or "packaging" configuration. The bottom tabs are then folded inward and glued or otherwise sealed to form a solid bottom for the carton. The second tongue that is pivotally attached to the strut column/support member along a fold line is now available for being pushed downward. If a bicycle is to be the product shipped within this carton, then a partially assembled bicycle is first placed within the large open area along the top of the carton such that one of the bicycle's wheels is placed into the elongated channel cutout. After that has occurred, the second tongue can be folded down against the wheel of the bicycle such that its deformable area is pressed against the wheel of the bicycle. This second tongue is to be pressed with sufficient firmness so that the deformable area of the second tongue will tend to split along the perforated fold lines, and the deformable "fingers" will then hold the bicycle wheel in place. Any other bicycle parts would then be placed into the smaller compartment, and the container becomes ready for final assembly. At this time, the top flaps can be folded down and sealed so that the final shipping carton completely encloses the packaged bicycle.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description and claims serve to explain the principles of the invention. In the drawings:

DETAILED DESCRIPTION OF THE PREFERRED EMBODIMENT

Reference will now be made in detail to the present preferred embodiment of the invention, an example of which is illustrated in the accompanying drawings, wherein like numerals indicate the same elements throughout the views.

Figure 1:
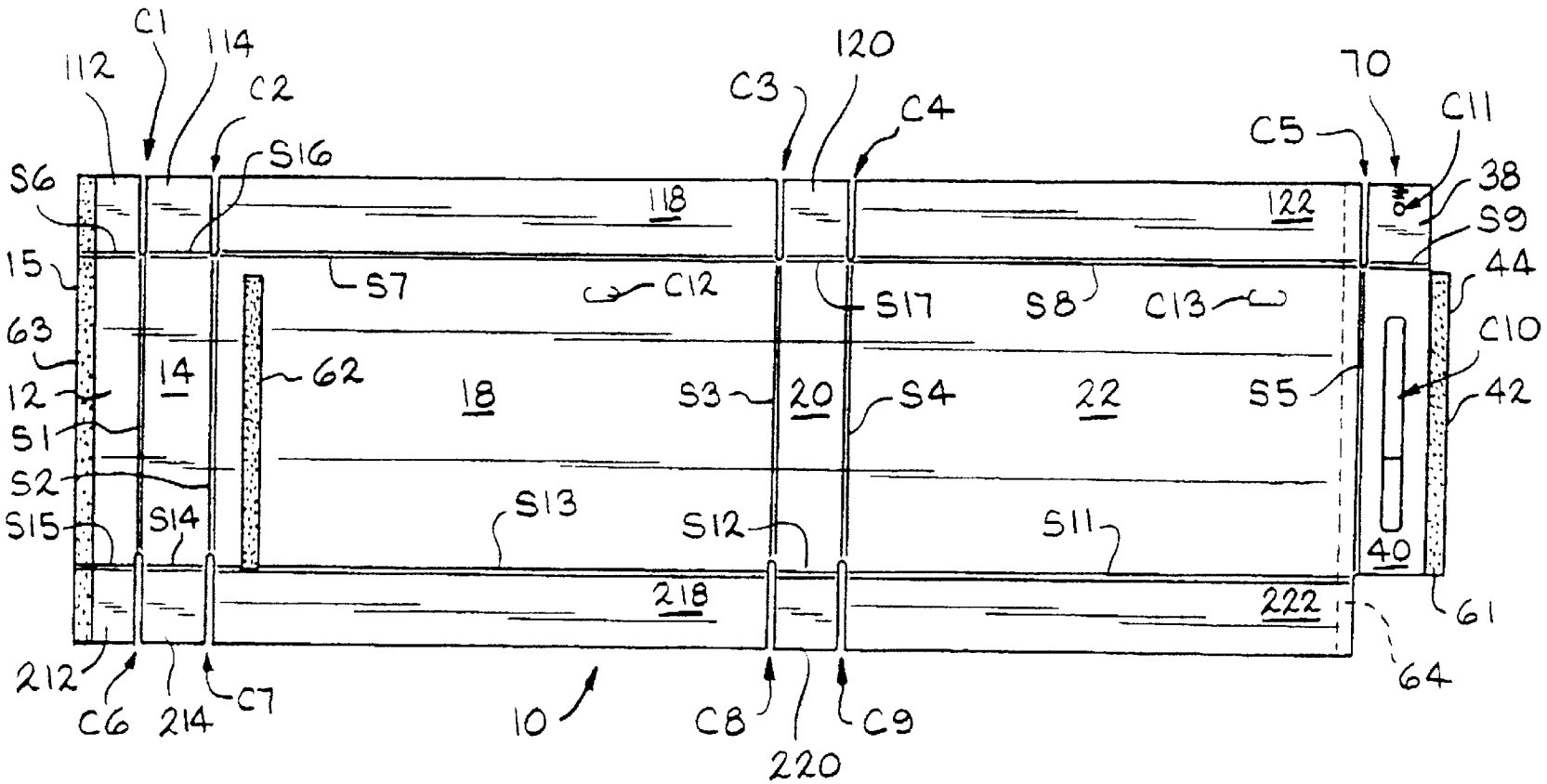
FIG. 1 is an elevational view of a container blank constructed according to the principles of the present invention, in which the blank is laid out flat while observing the inner surfaces.

Referring now to the drawings, FIG. 1 shows a container blank generally designated by the reference numeral 10, as constructed according to the principles of the present invention. Container blank 10 is generally rectangular in shape and preferably is formed of a sheet material such as corrugated paperboard; this substantially rectangular shape begins as a planar blank form. It is preferred that the entire shipping container be formed from this single sheet of corrugated paperboard (i.e., from a "unitary blank") that makes up container blank 10, thereby simplifying the process of erecting the container by the packager.

While container blank 10 is generally rectangular in shape, there are numerous fold lines, glue areas, and certain small cutouts, which will be described hereinbelow. As viewed in FIG. 1, container blank 10 is disposed vertically along its outer edges (on the left side of FIG. 1) and 44 (on the right side of FIG. 1), in which these edges 15 and 44 are vertical in this view. As viewed from vertical edge 15 to vertical edge 44, container blank 10 comprises a first partial back wall portion 12 having the outer vertical edge 15, and having a glue area 63 (i.e., an adherable area or strip); a first end wall 14; a front wall 18, which includes a glue area 62 (i.e., an adherable area or strip) and a first cutout C12; a second end wall 20; a second partial back wall portion 22, which includes a glue area 64 (i.e., an adherable area or strip) on its opposite side (which will become the outer side of the carton when it is folded), and a second cutout C13; and a strut column, or support member structure, generally designated by the reference numeral 40, which contains a first tongue member 42 that includes a glue area 61 (i.e., an adherable area or strip—also referred to as a "glue tab") and also includes the outer vertical edge 44, a vertical elongated cutout or slot C10, and a second tongue member 38, which is separated by a scored fold line S9. The second tongue member 38 is on the distal portion of the support member 40, past the fold line S9.

The various walls 12, 14, 18, 20, and 22 and the strut column/support member 40 all have vertical scored fold lines between them as indicated at S1, S2, S3, S4, and S5. By use of these vertical scored fold lines, each of the various walls are foldable with respect to one another. The walls 12, 14, 18, 20, and 22 also have top and bottom flap members at their distal ends, the top flap members being viewed on FIG. 1 at 112, 114, 118, 120, and 122, whereas the bottom flaps are viewed on FIG. 1 at 212, 214, 218, 220, and 222.

Each of these bottom and top flaps are configured with a scored fold line that divides the top and bottom flaps from their respective adjacent walls. Moreover, it is preferred that the scored fold lines for each of the top flaps be co-linear and further that each of the bottom flaps have horizontal score lines that are also co-linear. For the top flaps, the scored fold lines are indicated at S6, S16, S7, S17, and S8 for the main walls 12, 14, 18, 20, and 22, and further the scored fold line S9 for the strut column/support member 40 and its second tongue 38. If all of these scored fold lines preferably are co-linear, so that the top flaps can all be folded down as required to form a single co-planar surface.

The bottom scored fold lines depicted on FIG. 1 are S15, S14, S13, S12, and S11 for the main walls 12, 14, 18, 20, and 22. As discussed above, if all of these scored fold lines along the bottom part of the carton blank 10 are co-linear, then the bottom flaps 212, 214, 218, 220, and 222 can essentially be folded into a single co-planar surface at a later assembly stage. It will be understood that these scored fold lines described above will no longer be co-linear once the blank 10 is erected into a container at any of the assembly stages as depicted in the drawings herein. As will become apparent hereinbelow, when a container is formed from the carton blank 10, the various scored fold lines will have their adjacent members bent at an angular relationship to one another other than co-planar.

Wall 12, as one of the "outer" walls for example, is bounded by the outer edge 15 along its left boundary (as viewed on FIG. 1), fold line S6 along its top boundary (as viewed on FIG. 1), fold line S1 along its right boundary (as viewed on FIG. 1), and fold line S15 (as viewed on FIG. 1). Wall 18, as one of the "inner" walls for example, is bounded by fold line S2 along its left boundary (as viewed on FIG. 1), fold line S7 along its top boundary (as viewed on FIG. 1), fold line S3 along its right boundary (as viewed on FIG. 1), and fold line S13 (as viewed on FIG. 1).

The top flaps 112, 114, 118, 120, and 122 are also separated from each other by cut lines as illustrated on FIG. 1 by the reference markings C1, C2, C3, and C4, respectively. The bottom flaps 212, 214, 218, 220, and 222 are similarly separated from each other by similar cut lines, as viewed on FIG. 1 at C6, C7, C8, and C9, respectively. The strut column 10 includes its second tongue 38, which also is physically separated by a cut line C5 from the top flap 122.

The first tongue 42 has a glue area 61 that will become adhered to a similarly sized glue area 62 on the inner surface of the front wall 18. At a later stage of assembly, a glue area 63 on the first partial back wall portion 12 and its adjacent flaps 112 and 212 will become affixed to a similarly sized and shaped glue area 64 that is formed on the opposite (outer) surface of the second partial back wall portion 22 and its associated flaps 122 and 222. After this last gluing or adhering operation is performed, the carton blank 10 will be ready for either final assembly, or ready for being folded into a flat preform configuration to be shipped from the carton manufacturer to the packaging manufacturer.

The strut column/support member 40 is adjacent to the second partial back wall portion 22, while being separated by the scored fold line S5. Elongated cutout or slot C10 is disposed vertically (as viewed in FIG. 1) along the surface of the strut column/support member 40, and this elongated cutout C10 is shaped and sized to receive a bicycle wheel after the carton blank 10 has been erected. Strut column/support member 40 has a first tongue member at 42 that includes the glue area 61. In addition, strut column/support member 40 has a second tongue member at 38 that is foldable along the scored fold line S9. The second tongue 38 includes a hole or circular cutout at C11, and includes a deformable area generally designated by the reference numeral 70. The details of this deformable area 70 and cutout C11 are provided on FIG. 7.

The second tongue 38 is used as an extra reinforcing strut member, as it will be folded down within the confines of the carton blank 10 after it has been partially erected. The strut column/support member 40 itself forms a main reinforcing member within the erected container, and separates the front wall 18 and back wall 22 while providing some mechanical strengthening. At the same time strut column/support member 40 divides the inner spaces of the container into two separate volumes. This is more readily illustrated in the following views.

The cutouts C12 and C13 are essentially shaped and sized for use as handholds for carrying the wholly erected container, including after it has been loaded with a partially assembled bicycle and other associated parts. Of course, the hand-hold cutouts could be provided at other locations within the surface of carton blank 10 without departing from the principles of the present invention.

Figure 2:
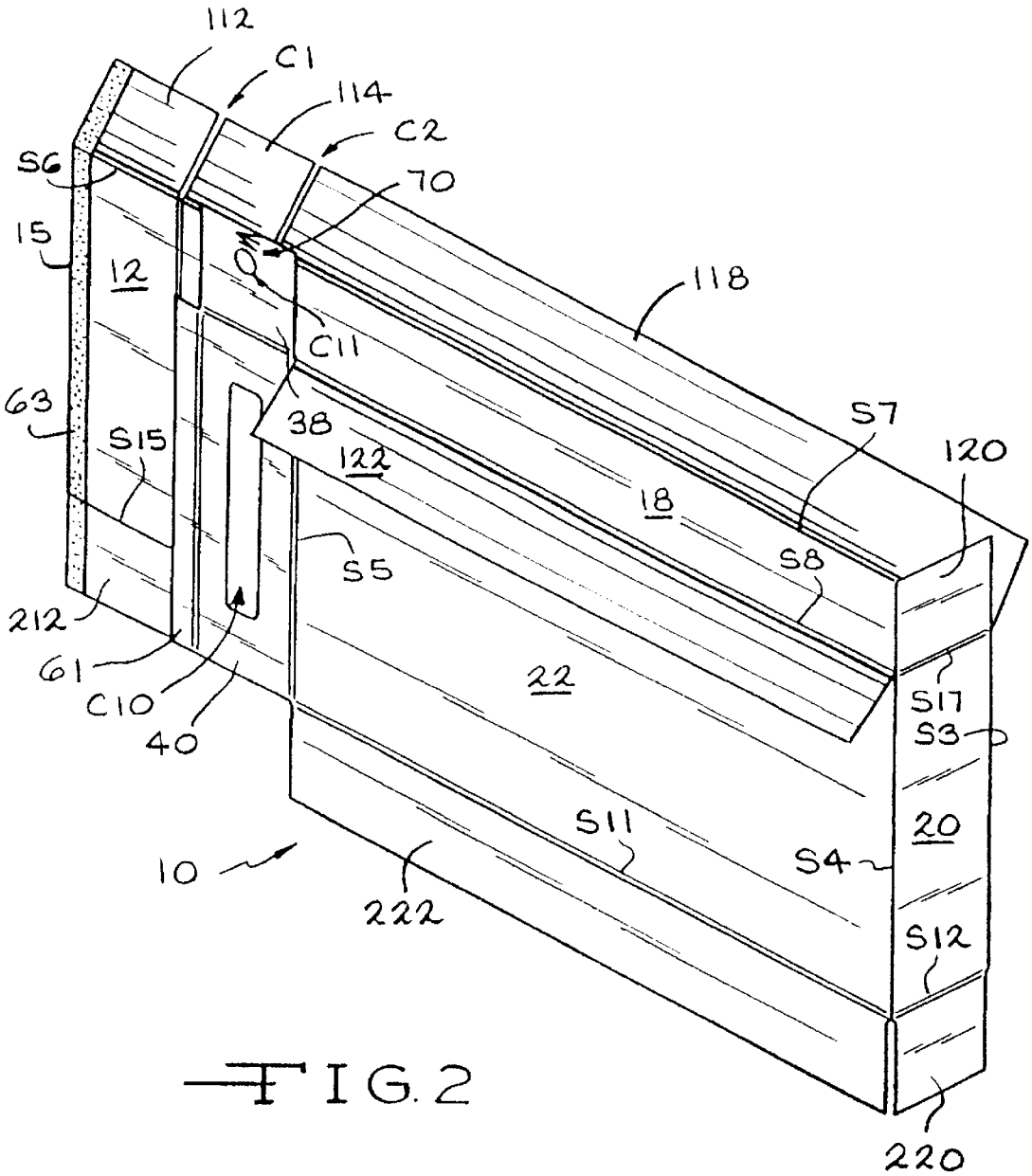
FIG. 2 is a perspective view from above and one side, illustrating the container blank of FIG. 1 in a partially erected configuration after two vertical folds have been made.

In FIG. 2 the carton blank 10 has been folded twice along scored fold lines S3 and S4. As viewed in FIG. 2, the second partial back wall portion 22 is closest to the observer, and is substantially in parallel with the front wall 18. The angles formed by the front wall 18 and second end wall 20 along fold line S3, and between the partial back wall 22 and second end wall 20 along fold line S4, are approximately right angles in this view.

Figure 3:
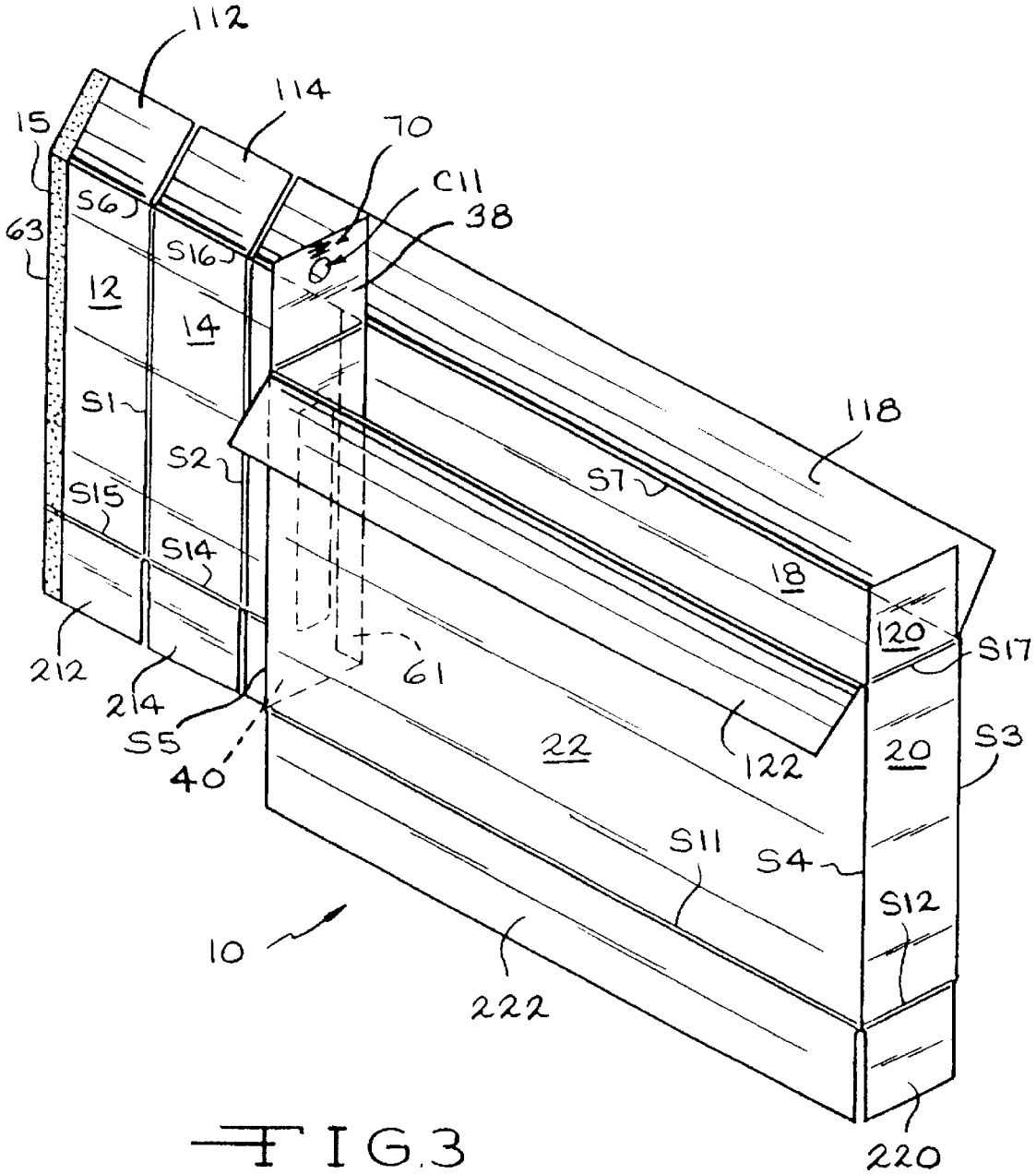
FIG. 3 is a perspective view from above and one side, illustrating the container blank of FIG. 1 in a partially erected configuration after a third vertical fold has been made and after a strut column/support member has been affixed to the inner surface of one of the walls.

FIG. 3 illustrates the partially erected carton blank 10 after a third fold has been made along the scored fold line S5. In this view, the strut column/support member 40 has been affixed to the inner surface of the front wall 18 by use of the glue areas 61 and 62 being mated together. In this configuration, the strut column/support member 40 acts as a support structure (or column) between the two parallel walls 18 and 22, although the carton is still able to be folded flat, if desired.

Figure 4:
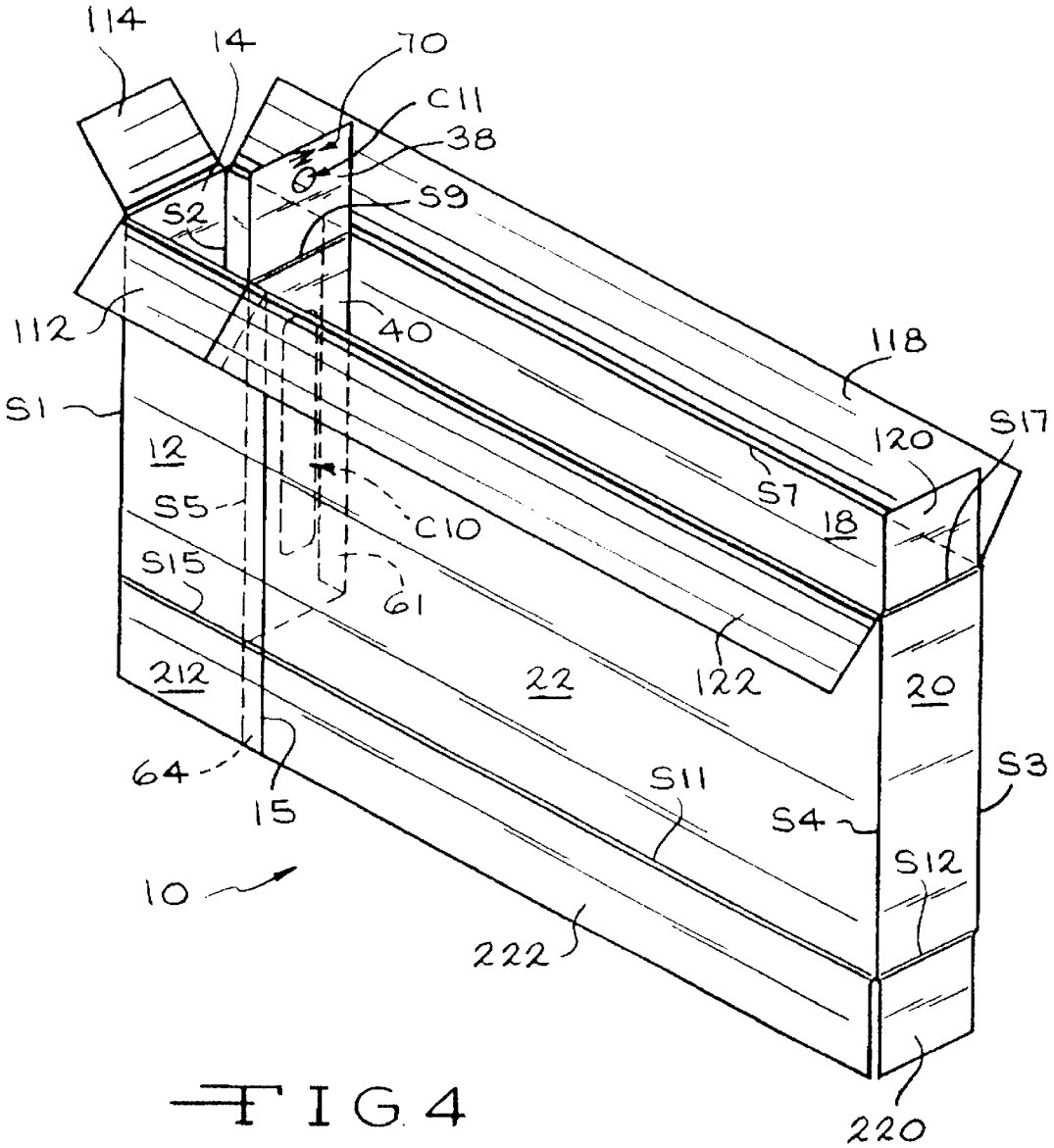
FIG. 4 is a perspective view from above and one side, illustrating the container blank of FIG. 1 in a partially erected configuration after two final vertical folds have been made, and after an overlapping wall has been affixed to one of the main walls.

In FIG. 4, the partially erected carton blank 10 has had two more folds made along the scored fold lines SI and S2. In this configuration, the first end wall 14 is now parallel to the second end wall 20, and further the first partial back wall 12 has now been mated to the remaining major portion of the back wall 22. These two back wall portions 12 and 22 now act as a single structure that is substantially co-planar (except for small overlapping). The actual joining between these two wall portions 12 and 22 occurs along the left vertical edge 15 (as seen in FIG. 1), which has a glue area 63 on the inner surface of carton blank 10 that mates up to a second glue area 64 that is applied to the outer surface of the second back wall portion 22. When these two glue areas 63 and 64 are affixed together, their respective top and bottom flaps (i.e., 112 and 122, and 212 and 222) also become a substantially unitary structure that will fold together along their respective fold lines S6 and S8 (i.e., for the combined top flap 112 and 122) and fold lines S15 and S11 (for the combined bottom flap 212 and 222).

Figure 5:
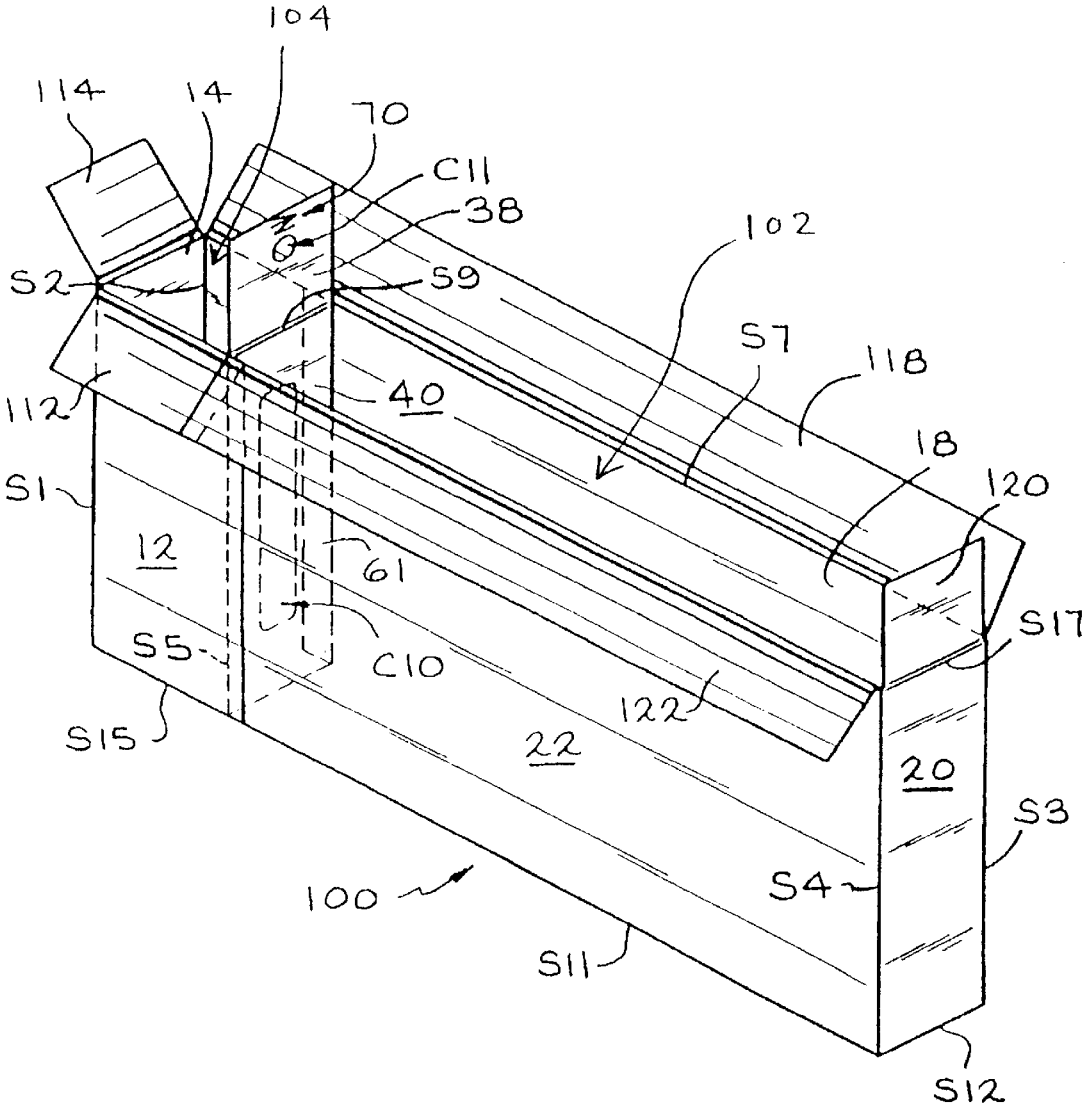
FIG. 5 is a perspective view from above and one side, illustrating the container blank of FIG. 4 in a partially erected configuration after the bottom flaps have been assembled, in a "packaging" configuration.

FIG. 5 shows the carton blank now formed into a fully erected carton assembly or container 100 that is ready to receive the manufactured goods that are to be shipped therewithin. The main difference between FIGS. 4 and 5 is that the bottom flaps 212, 214, 218, 220, and 222 in FIG. 5 have been folded along their respective scored fold lines S15, S14, S13, S12, and S11 so that they form the bottom wall of the container 100. In this "packaging" configuration, the container 100 can no longer be folded into a flat profile, since the bottom flaps are now fixed in place by stapling, gluing, taping, or some other means of securing those bottom flaps in place with respect to the remaining surfaces of the container.

At this time, the partially assembled bicycle can be inserted between the major volumes of the front wall 18 and the second partial back wall portion 22, such that one of the wheels of the bicycle would fit into the elongated slot C10 in the strut column/support member 40. The portion of the container 100 used for holding the partially assembled bicycle is the larger portion, which comprises a first containment volume that is generally designated on FIG. 5 by the reference numeral 102. After that has been accomplished, the second tongue 38 could be folded down along its adjacent scored fold line S9 until its deformable area 70 engages one of the wheels of the partially assembled bicycle. Further details of this deformable area 70 are provided hereinbelow, in reference to FIG. 7.

In addition, other parts of the bicycle assembly can be stored in the separate compartment that is between the front wall 18 and the first partial back wall portion 12. This separate compartment comprises a second containment volume that is generally designated on FIG. 5 by the reference numeral 104.

Figure 6:
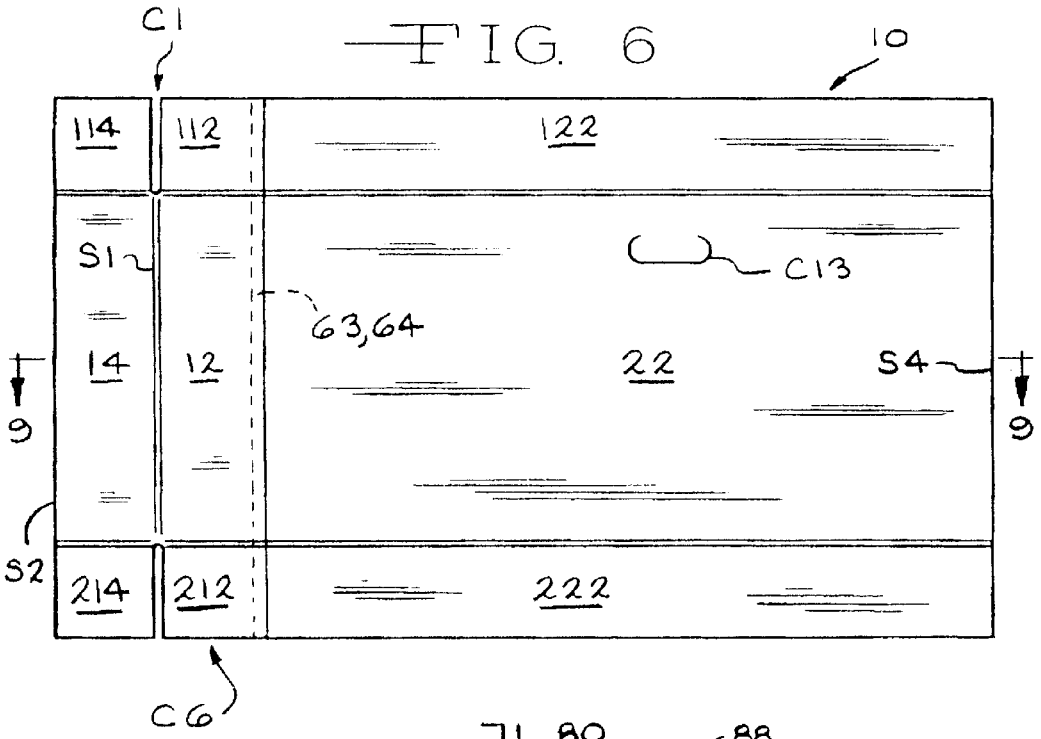
FIG. 6 is an elevational view of the partially erected carton of FIG. 4, in which the carton has been folded as a flat preform in a flat "shipping" configuration.
Figure 9:
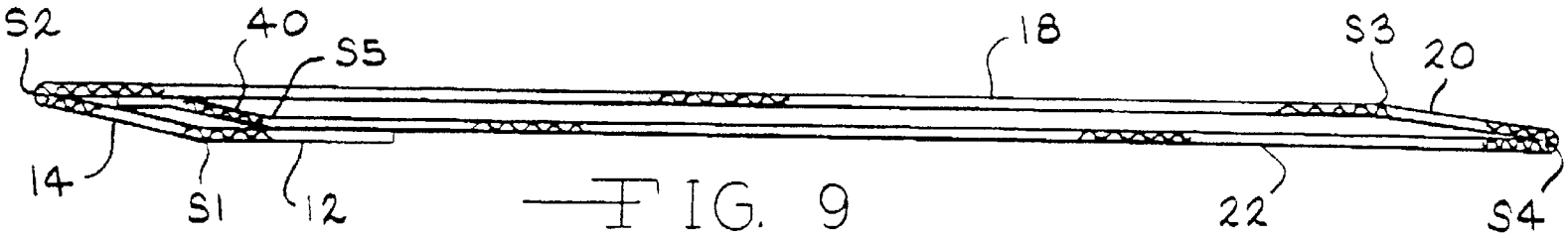
FIG. 9 is a transverse planar cross-sectional view of the flat shipping preform of FIG. 6, taken along the section lines 9—9.

FIG. 6 illustrates the carton blank 10 after it has been partially erected as per its appearance in FIG. 4, but before the bottom flaps are fixed in place as per FIG. 5. In FIG. 6, the main front wall 18 and back wall main portion 22 are not only parallel to one another, but they are in fairly close contact with one another, as can be easily viewed in the cross-sectional view of FIG. 9 for this configuration of the flat "shipping" configuration preform. In FIG. 9, the main walls 18 and 22 (along with the wall portion 12) form a parallelogram with the end walls 14 and 20 (as viewed in a transverse planar cross-section). In addition, the strut column/support member 40 will maintain a substantially parallel orientation with respect to the end walls 14 and 20, regardless of the actual angle that the carton has been folded into with respect to the angles at the fold lines S3 and S4, for example. The strut column/support member 40 will remain fixedly attached to both the front wall 18 and the back wall 22 by virtue of its fold line S5 (at wall 22) and its glue areas 61 and 62 (at the front wall 18).

Figure 8:
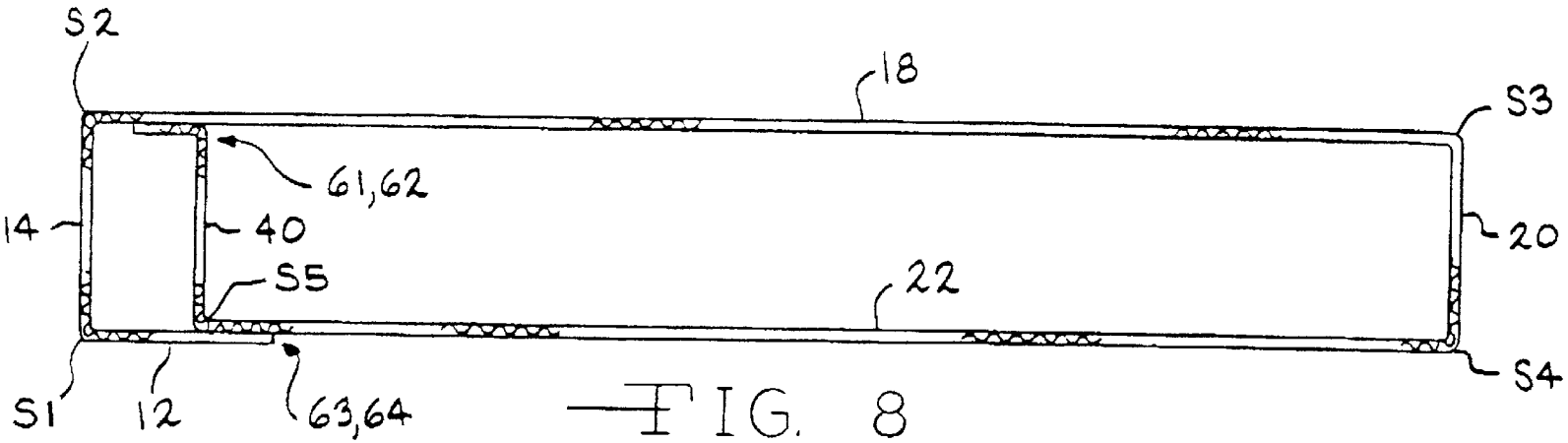
FIG. 8 is a transverse planar cross-sectional view of the partially erected carton of FIG. 4, in its rectangular configuration.
Figure 10:
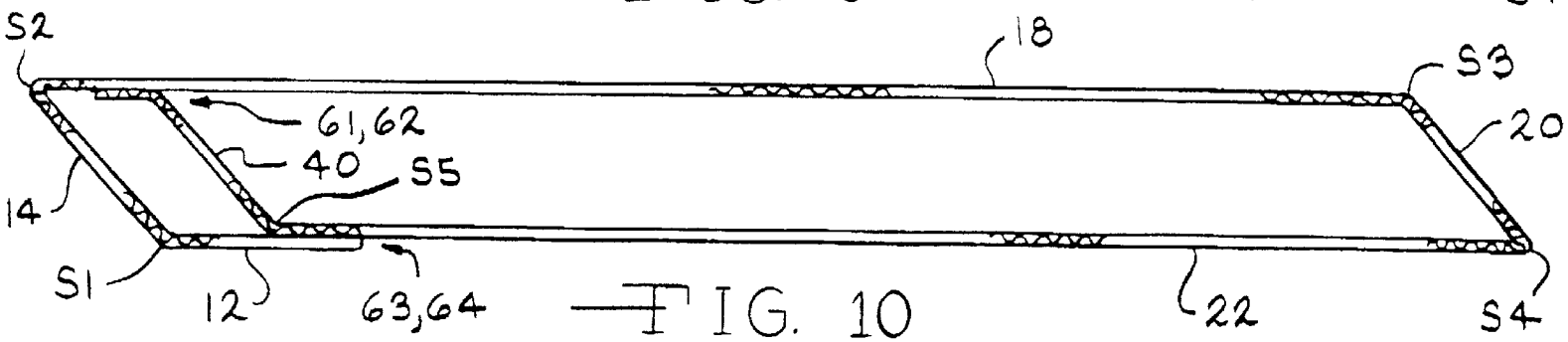
FIG. 10 is a transverse planar cross-sectional view of the partially erected carton of FIG. 8, in which the carton has begun to be collapsed into its flat preform shipping configuration.

As can be seen from viewing FIGS. 8, 9, and 10, the carton blank 10 in its partially-erected preform can be made into a rectangle (as per FIG. 8), a flat profile parallelogram (as per FIG. 9), or a more fully bodied parallelogram (as per FIG. 10). In each of these configurations, the front wall 18 and back wall 22 remain parallel to one another, while the end walls 14 and 20 also remain parallel to each other. Furthermore, the strut column/support member 40 remains parallel to the end walls 14 and 20 in each of these views. Of course, the most useful forms of the partially-erected carton preform are those forms illustrated in FIGS. 8 and 9, in which the shipping configuration as a flat preform is illustrated in FIG. 9 (as viewed in a transverse planar cross-section), while the final shape when used to contain manufactured items is illustrated in FIG. 8 (again, as viewed in a transverse planar cross-section). The view of FIG. 10 (as viewed in a transverse planar cross-section) is provided merely to more fully explain the construction features of this carton.

Figure 7:
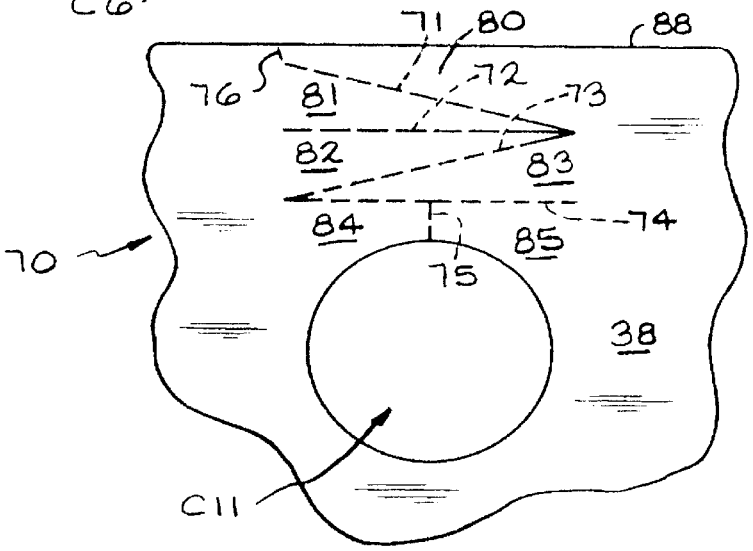
FIG. 7 is a close-up view of the deformable area of a tongue of the strut column/support member of the carton of FIG. 1.

FIG. 7 illustrates the details of the deformable area 70 of the second tongue 38 that is foldably attached to the strut column/support member 40. Circular cutout C11 is formed near the vertical centerline of the second tongue 38, and several perforated fold lines extend above this cutout C11 (as viewed on FIG. 7). These perforated fold lines are indicated at the reference numerals 71, 72, 73, 74, and 75, and further a small tear-away portion at 76 will inevitably manifest itself when a sufficient force is pressed along the top edge (as viewed on FIG. 7) at 88, which will cause this deformable area 70 to actually deform.

Figure 11:
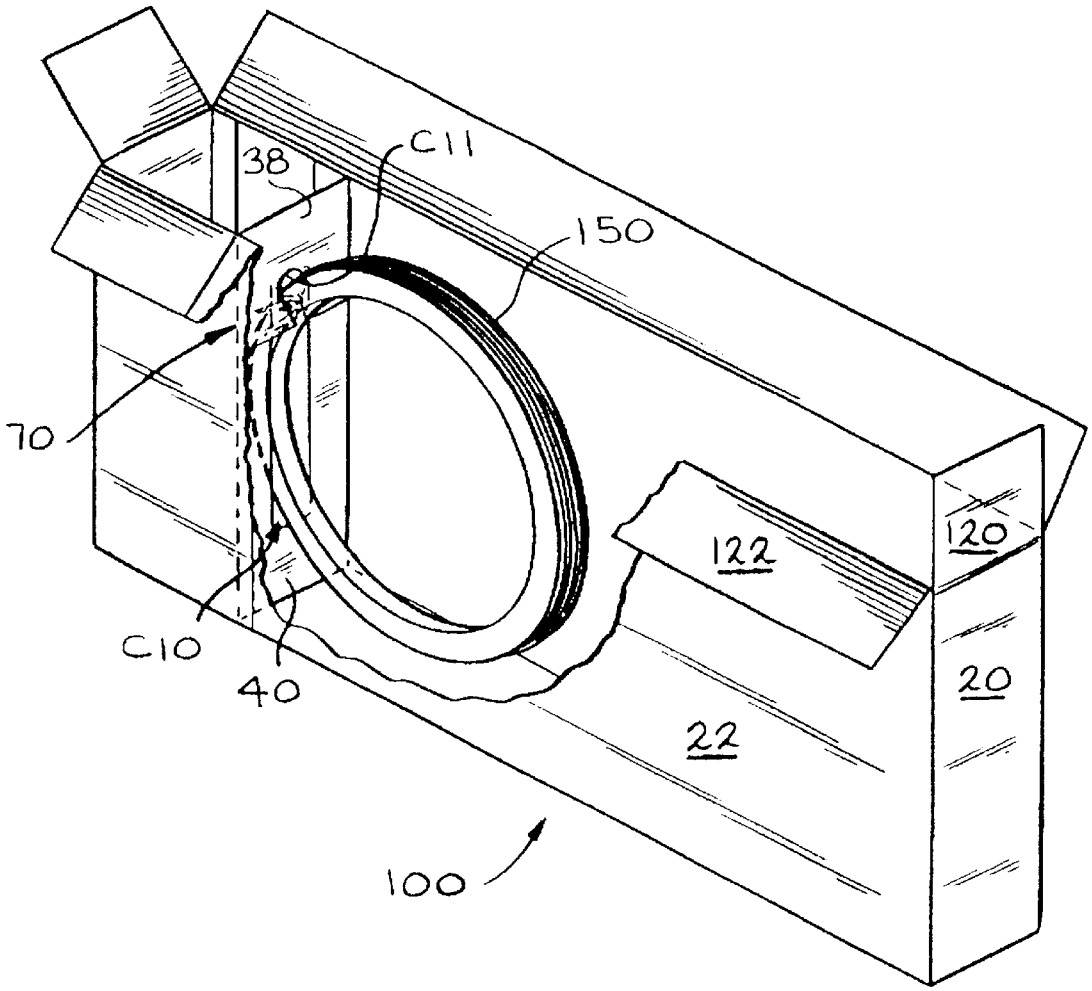
FIG. 11 is a perspective view in partial cross-section of the partially erected carton of FIG. 5, illustrating a wheel of a bicycle as it would be mounted inside the carton and mounted into openings in the strut column/support member and deformable area of the second tongue.
Figure 12:
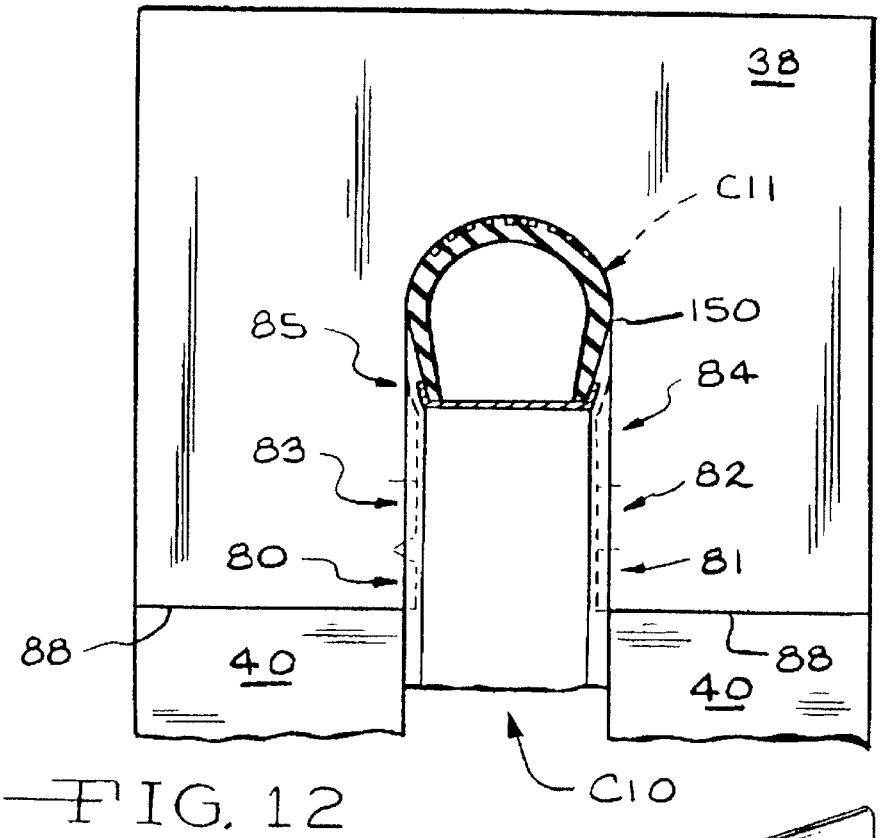
FIG. 12 is an elevational view of a portion of the strut column/support member and second tongue of FIG. 11, also depicting a wheel of a bicycle as it is held in place by these members.
Figure 13:
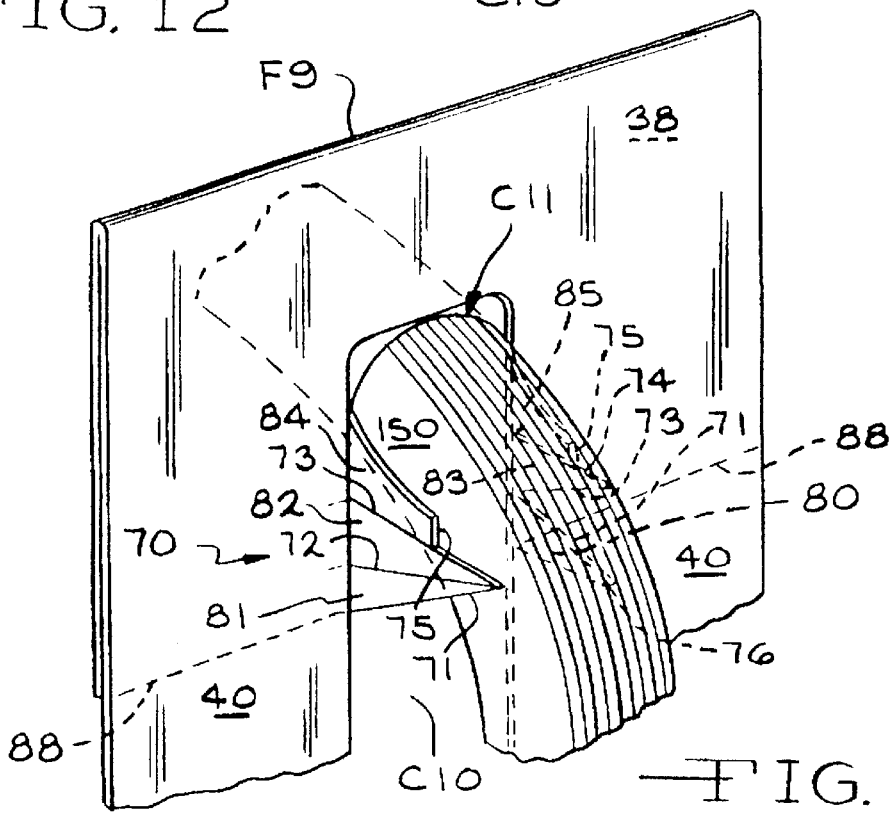
FIG. 13 is a perspective view of the strut column/support member and second tongue of FIG. 12 from the opposite side as depicted in FIG. 12, holding a bicycle wheel in place.

The perforated fold lines 71–75 are constructed so as to cause portions of the paperboard material to readily break-away upon a medium impact, such as when the second tongue member 38 is folded down against the surface of a bicycle wheel (see FIGS. 11, 12, and 13 for more detail). When these perforated fold lines 71–75 actually cause the paperboard material to separate therealong, a set of triangular "fingers" will appear as small wedges at 80, 81, 82, and 83. Furthermore, two other areas will become separated along a centerline 75, that is at the areas 84 and 85 on FIG. 7.

On FIG. 11, it can be seen that a bicycle wheel 150 can be placed into the deformable area 70 and which will cause these deformable fingers 80–83 to tend to break apart from one another and to deform while holding against the bicycle wheel 150. As seen in FIG. 11, the bicycle wheel 150 is placed into the elongated slot C10 of the strut column/support member 40, although this by itself will not necessarily keep the orientation of the bicycle wheel 150 in a constant location. However, the deformable fingers 80–83 will tend to remain pressed against the bicycle wheel 150, which can be seen more readily in FIGS. 12 and 13.

In FIG. 12, the bicycle wheel 150 is depicted as being inserted into a portion of the cutout C11. In this orientation, the deformable fingers 80–83 will nevertheless remain in place substantially against the wheel 150, and also the deformable areas 84 and 85 will likely remain against the wheel 150. This feature can also be viewed in the perspective view of FIG. 13, which illustrates the opposite side of the strut column/support member 40, and shows the deformable "fingers" 80–83 in greater detail. Thus the tendency for the bicycle wheel to move up or down within the elongated slot C10 of the strut column/support member 40 will be greatly reduced. The bicycle wheel 150 will also not have a tendency to move to the left or right as seen in FIG. 12.

It will be understood that other non-proportional dimensions could be utilized to create a carton blank that can be erected into a parts container to hold manufactured goods in place, without departing from the principles of the present invention. It further will be understood that the glue areas depicted on the drawings could be changed or modified so that only one glue area is used per tab or tongue member, or the glue areas could be positioned at different locations, also without departing from the principles of the present invention. Furthermore, it will be understood that the deformable area of the second tongue of the strut column could be made in an entirely different geometry while still maintaining the orientation of a bicycle wheel or other manufactured goods, without departing from the principles of the present invention. Moreover, it will be understood that the strut column could be configured in many different ways to hold manufactured goods in place while also providing a separation between compartments within the container, without departing from the principles of the present invention.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A shipping carton blank formed from a unitary sheet of material, said shipping carton blank comprising:

(a) a first wall having a first outer edge, a boundary at a first fold line, a first flap, a second flap, and a first adherable area proximal to said first outer edge on an inner surface of said shipping carton blank;

(b) a second wall having a boundary at said first fold line, a boundary at a second fold line, a third flap, and a fourth flap;

(c) a third wall having a boundary at said second fold line, a boundary at a third fold line, a fifth flap, and a sixth flap;

(d) a fourth wall having a boundary at said third fold line, a boundary at a fourth fold line, a seventh flap, and an eighth flap;

(e) a fifth wall having a boundary at said fourth fold line, a boundary at a fifth fold line, a ninth flap, and a tenth flap, and a second adherable area proximal to said fifth fold line on an outer surface of said shipping carton blank; and (f) a support member having a boundary at said fifth fold line, a second outer edge, and a tongue member on a distal portion of a sixth fold line; said tongue member having a deformable area proximal to a third outer edge.

2. The shipping carton blank as recited in claim 1, wherein said unitary sheet of material comprises corrugated paperboard.

3. The shipping carton blank as recited in claim 1, wherein said first and second adherable areas comprise glue strips.

4. The shipping carton blank as recited in claim 1, wherein the deformable area of the tongue member of said support member comprises a plurality of perforated lines that cause areas of said support member to readily break-away upon a medium impact, wherein said break-away areas assist in holding in place an article placed against said support member.

5. A shipping container formed from the shipping carton blank as recited in claim 2, wherein said third wall, fourth wall, fifth wall, and support member are folded along said third, fourth, and fifth fold lines, such that a third adherable area of said support member proximal to said second outer edge comes into contact against an inner surface of said third wall and is secured thereto, thereby forming a first containment volume; and said first wall, second wall, and third wall are folded along said first and second fold lines, such that said first adherable area comes into contact against said second adherable area and is secured thereto, thereby forming a second containment volume.

6. The shipping container as recited in claim 5, wherein said first, second, third, fourth, and fifth fold lines are substantially parallel.

7. The shipping container as recited in claim 5, wherein the third adherable area of said support member comprises a glue tab, and further comprising a mating glue area on the inner surface of said third wall, thereby forming a column barrier between said first and second containment volumes.

8. The shipping container as recited in claim 7, wherein said support member exhibits an elongated slot for receiving an article, and wherein the deformable area of the tongue member of said support member comprises a plurality of perforated lines that cause areas of said support member to readily break-away upon a medium impact, wherein said break-away areas assist in holding in place said article when placed against said support member.

9. The shipping container as recited in claim 6, wherein said third wall and fifth wall remain substantially parallel to one another, and wherein said second wall, fourth wall, and support member remain substantially parallel to one another, regardless of the actual angle between said walls at said fold lines; thereby allowing said shipping container to be folded substantially flat in a shipping configuration, or to be folded in a substantially rectangular shape in a packaging configuration.

10. The shipping container as recited in claim 9, wherein said second, fourth, sixth, eighth, and tenth flaps are folded and secured to form a bottom wall of said shipping container; and wherein said second, fourth, sixth, eighth, and tenth flaps are separated from their respective adjacent first, second, third, fourth, and fifth walls by fold lines that are substantially co-linear when said shipping carton blank is laid out flat.

11. The shipping container as recited in claim 10, wherein said first, third, fifth, seventh, and ninth flaps are folded and secured to form a top wall of said shipping container; and wherein said first, third, fifth, seventh, and ninth flaps are separated from their respective adjacent first, second, third, fourth, and fifth walls by fold lines that are substantially co-linear when said shipping carton blank is laid out flat.

12. The shipping container as recited in claim 9, further comprising: (a) a plurality of cut lines between each adjacent pair of said first, third, fifth, seventh, and ninth flaps, and between each adjacent pair of said second, fourth, sixth, eighth, and tenth flaps; and (b) at least one cutout for use as a hand-hold in each of said third wall and said fifth wall.

13. A method for partially erecting a shipping carton from a unitary sheet of material, said method comprising:

(a) providing a carton blank comprising:

(i) a first wall having a first outer edge, a boundary at a first fold line, and a first adherable area proximal to said first outer edge on an inner surface of said shipping carton blank;

(ii) a second wall having a boundary at said first fold line, and a boundary at a second fold line;

(iii) a third wall having a boundary at said second fold line, and a boundary at a third fold line;

(iv) a fourth wall having a boundary at said third fold line, and a boundary at a fourth fold line;

(v) a fifth wall having a boundary at said fourth fold line, a boundary at a fifth fold line, and a second adherable area proximal to said fifth fold line on an outer surface of said shipping carton blank; and (vi) a support member having a boundary at said fifth fold line, a second outer edge, and a third adherable area proximal to said second outer edge;

(b) folding said third wall, fourth wall, fifth wall, and support member along said third, fourth, and fifth fold lines, such that third adherable area comes into contact against an inner surface of said third wall and is secured thereto, thereby forming a first containment volume; and (c) folding said first wall, second wall, and third wall along said first and second fold lines, such that said first adherable area comes into contact against said second adherable area and is secured thereto, thereby forming a second containment volume.

14. The method as recited in claim 13, further comprising: folding two of said first, second, third, or fourth fold lines at an acute angle so as to substantially flatten said partially erected shipping carton into a shipping configuration;

wherein said third wall and fifth wall remain substantially parallel to one another, and wherein said second wall, fourth wall, and support member remain substantially parallel to one another.

15. The method as recited in claim 14, further comprising: unfolding said two of the first, second, third, or fourth fold lines so as to form said partially erected shipping carton into a substantially rectangular packaging configuration; wherein said third wall and fifth wall remain substantially parallel to one another, wherein said second wall, fourth wall, and support member remain substantially parallel to one another; and wherein said first, second, third, and fourth fold lines each exhibit a substantially right angle with respect to their corresponding adjacent wall surfaces.

16. The method as recited in claim 15, further comprising: folding a bottom flap of at least one of said second wall, third wall, fourth wall, or fifth wall along a bottom fold line, so as to create a bottom wall of said partially erected shipping carton; placing an article into said first containment volume, such that a surface of said article is placed into an elongated slot of said support member; folding a tongue member of said support member along a sixth fold line, such that a deformable area proximal to a third outer edge of said tongue member contacts the surface of said article, and thereby assists in holding in place said article.

17. The method as recited in claim 16, wherein said deformable area comprises a plurality of perforated lines that cause areas of the tongue member of said support member to readily break-away upon a medium impact, wherein said break-away areas assist in holding in place said article when placed against said tongue member.

18. The method as recited in claim 16, further comprising: folding a top flap of at least one of said second wall, third wall, fourth wall, or fifth wall along a top fold line, so as to create a top wall of said partially erected shipping carton.

* * * * *